United States Patent [19]

Barger

[11] Patent Number: 4,484,161

[45] Date of Patent: Nov. 20, 1984

[54] SILICONE RUBBER FOR RELIEVING STRESS IN MAGNETIC MATERIAL

[75] Inventor: Dale M. Barger, Los Altos, Calif.

[73] Assignee: Varian Associates, Inc., Palo Alto, Calif.

[21] Appl. No.: 381,665

[22] Filed: May 24, 1982

[51] Int. Cl.[3] ..... H01P 1/218; H01F 7/00

[52] U.S. Cl. ..... 333/202; 335/217

[58] Field of Search ..... 335/217, 208, 296, 297, 335/298, 221; 336/179, 178; 333/229, 234, 202

[56] References Cited

U.S. PATENT DOCUMENTS 3,187,237 6/1965 Craig ..... 335/217

3,228,091 1/1966 Rice et al. ..... 339/176

3,281,732 10/1966 Blake et al. ..... 336/179 X 3,662,304 5/1972 Bringe et al. ..... 335/297

*Primary Examiner*—Paul L. Gensler

*Assistant Examiner*—Benny Lee

*Attorney, Agent, or Firm*—Stanley Z. Cole; Keiichi Nishimura

[57] ABSTRACT

When two pieces of magnetic material are clamped together in a magnetic circuit, a silicone rubber piece is used to control the clamping pressure in order not only to prevent material stress at the clamping surfaces but also to compensate for the effects of temperature expansion of the magnetic material.

11 Claims, 4 Drawing Figures

SILICONE RUBBER FOR RELIEVING STRESS IN MAGNETIC MATERIAL

DESCRIPTION

BACKGROUND OF THE INVENTION

This invention relates to a magnetic circuit and in particular to a use of silicone rubber for relieving material stress in magnetic material in a magnetic circuit.

When two pieces of magnetic material are clamped together in a magnetic circuit, it is often necessary to control the clamping pressure so as not to stress the material along the clamping surfaces. This is particularly true where, as in the case of YIG-tuned filters, all parameters of the magnetic circuit are critical. Such resonators are disclosed, for example, in U.S. Pat. No. 3,544,918 issued Dec. 1, 1972 to W. E. Venator, Jr., and U.S. Pat. No. 3,879,677 issued Apr. 22, 1975 to C. A. Arnold. One of the conventional methods of reducing the effects of material stress under such circumstances was to make the clamp surface area much larger than the pole tip surface area. If the clamping surface area is made sufficiently large, the flux density thereacross may correspondingly become so low that the effects of material stress are insignificant. Making the clamping surfaces large adds weight to the magnetic circuit, however, and it is not desirable or even practicable in many applications to use large clamping surfaces. In such cases, spring clamping or controlling screw torque has been used, but neither of these previous methods is very satisfactory because they do not stand up well under shock or vibration.

As for the effects of temperature change on the material stress, none of these prior art methods mentioned above provides any compensation for thermal expansion, or eliminates stress hysteresis to be described later.

SUMMARY OF THE INVENTION

It is an object of the present invention to provide a method of relieving stress in clamped pieces of magnetic material in a magnetic circuit.

It is another object of this invention to provide a method of clamping two pieces of magnetic material together which method not only achieves the object described above but stands up well under shock and vibration and also compensates for temperature expansion.

It is a further object of this invention to provide a magnetic circuit structure in which either of the methods described above is used.

DETAILED DESCRIPTION OF THE INVENTION

Figure 1:
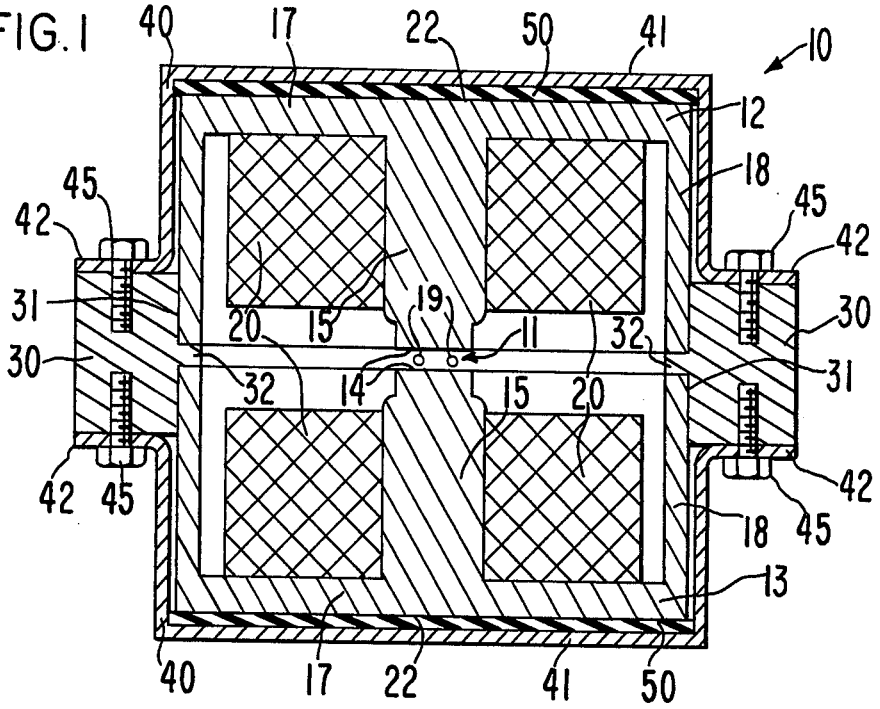
FIG. 1 is a sectional view of an assembly for providing a magnetic circuit incorporating the present invention.

Referring now to FIG. 1, there is shown a magnetic circuit 10 incorporating the present invention. This circuit may typically be used for a YIG-tuned filter and a magnetic field to be used for such purposes is created in gap 11 of two identically structured and symmetrically disposed magnetic circuit structures 12 and 13, or more specifically, between their pole tips 14. Ferromagnetic resonators such as YIG resonators 19 disclosed, for example, in U.S. Pat. No. 3,544,918 issued to W. E. Venator, Jr. and U.S. Pat. No. 3,879,677 issued to C. A. Arnold may be placed in this magnetic field. Structures 12 and 13 are each a single piece of magnetic material such as a nickel-iron alloy which may typically be used for an electromagnet and essentially consists of a generally cylindrical magnetic core piece 15 and a housing member which is generally shaped like a cup having a disc-shaped bottom piece 17 and a tubular wall 18. One end of core 15 attaches to bottom piece 17, while the other end thereof is the pole tip 14, facing gap 11 and adapted to serve as a magnetic pole piece. The useful magnetic field in gap 11 is established by a current source (not shown) with magnetizing coils 20 which are housed inside walls 18 and wound around cores 15. The external side of each bottom piece 17, i.e., the side distal core 15, is a flat circular surface 22.

Structures 12 and 13 are positioned symmetrically with respect to each other, sandwiching therebetween an annular support piece 30 of magnetic material, having cylindrical inner walls 31 and ledges 32 in such a way that structures 12 and 13 can be slidably moved along inner walls 31 and positioned opposite to each other, the housing members resting on ledges 32 by the walls 18.

Structures 12 and 13 are held compressed against support piece 30 by means of metallic end pieces 40 so as to form a magnetic circuit which is completely closed except for gap 11. Each of the end pieces 40 is shaped like a hat and comprises a cover sheet 41 and a rim-like peripheral flange section 42. The flange section 42 is provided with holes and can be fastened to support piece 30 by means of screws 45. A flat disc-shaped silicone rubber piece 50 is placed on top of, and substantially entirely covers each of flat surfaces 22 of bottom piece 17. Cover sheets 41 of end pieces 40 are designed not only to cover silicone rubber pieces 50 substantially entirely but also to adjustably compress structures 12 and 13 against support piece 30 through silicone rubber pieces 50, the compressive pressure being controlled by appropriately selecting the dimensions of covers 40 and of silicone rubber pieces 50.

Figure 2:
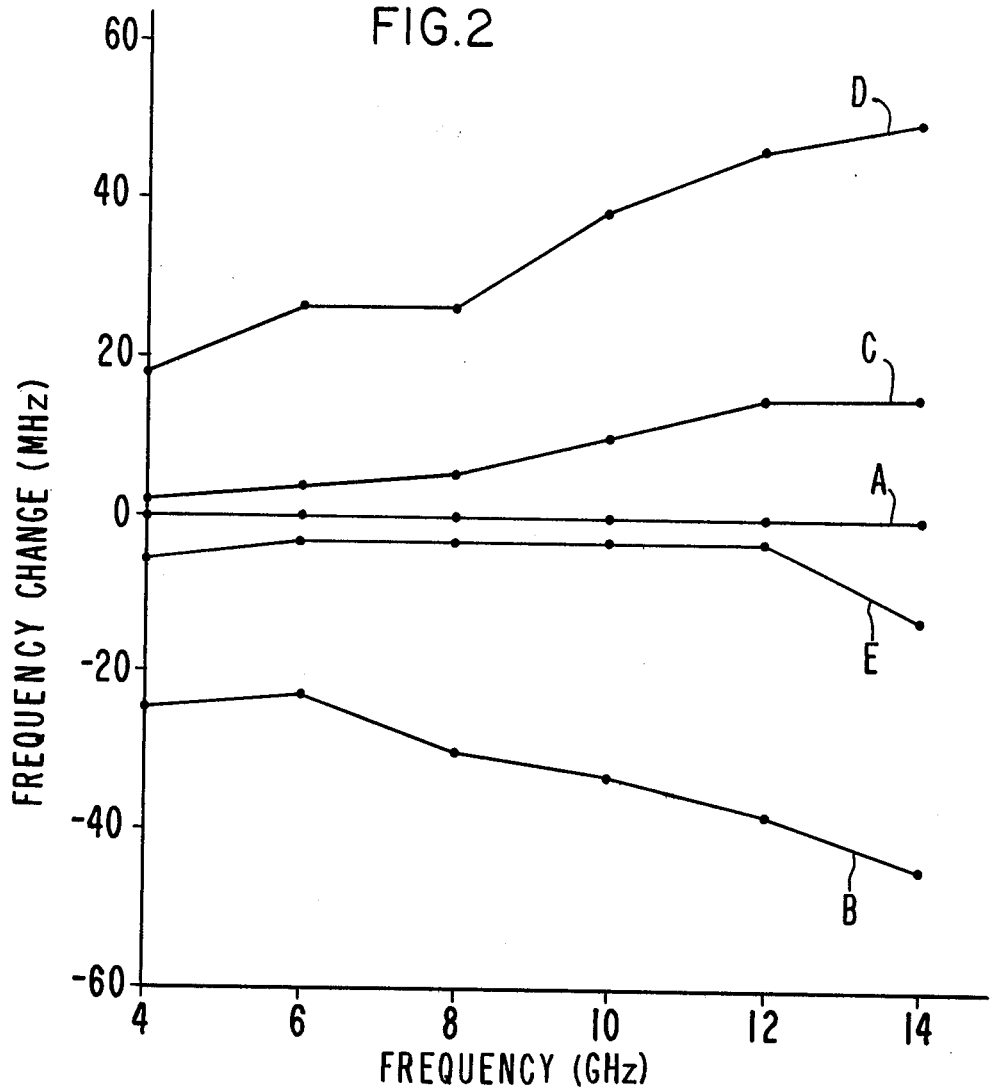
FIG. 2 is a graph showing the frequency drift caused by temperature changes in a YIG-tuned filter which uses the assembly shown in FIG. 1 as a source of magnetic field except the silicone rubber pieces therein are replaced by stainless steel discs.
Figure 3:
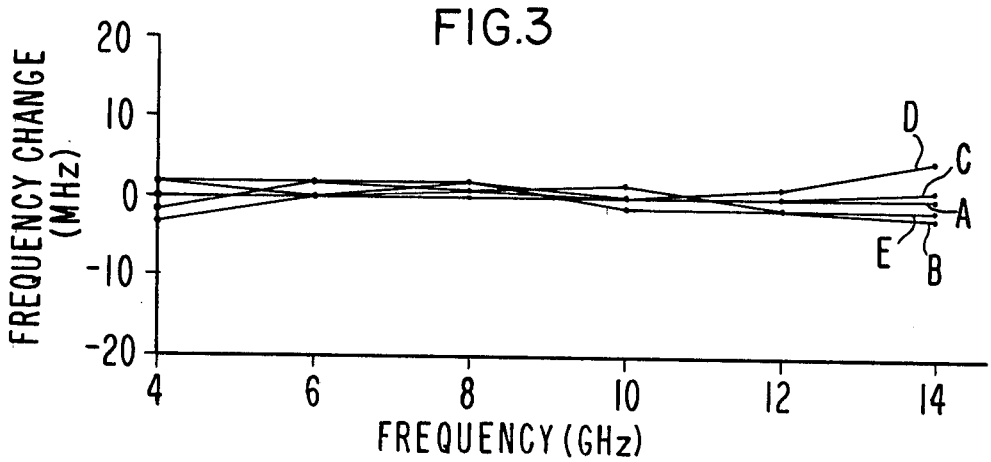
FIG. 3 is a graph showing the frequency drift measured similarly as for FIG. 2 except the silicone rubber pieces shown in FIG. 1 were used instead of stainless steel discs.

FIGS. 2 and 3 show the advantages of the present invention by way of a series of experiments which were performed with a YIG-tuned filter using a magnetic circuit of the type described above and illustrated in FIG. 1. In these experiments, the frequency drift caused by material stress was measured by changing the ambient temperature. In the first series of experiments the silicone rubber pieces 50 of FIG. 1 were replaced by stainless steel discs in order to represent a filter using a prior art clamping method. In the second series of experiments, by contrast, the silicone rubber pieces were back in their places as shown i FIG. 1. For both series of experiments, ambient temperature was changed from 25° C. (A) first upward to 100° C. (B), then back to 25° C. (C), then further downward to −50° C. (D), and finally back again to 25° C. (E). The measured values of frequency drift are shown in FIGS. 2 and 3 for the first and second series of experiments, respectively. The letters in parentheses indicate the position in the above-described temperature cycle at which the measurements were taken. For example, C indicates not only that the measurements were taken when the ambient temperature was 25° C., but also that the temperature was being lowered from 100° C. This distinction is important because, as is clear from FIG. 2, the frequency drift is dependent not only upon temperature, but also on the history of changes in material stress. This effect is similar to magnetic hysteresis and is often called stress hysteresis.

For convenience, frequency drift is plotted both in FIGS. 2 and 3 with respect to its initial values, i.e., Curves A are straight lines at zero in both these figures. It is of interest to note in FIG. 2 not only the effect of stress hysteresis (there being an overshoot when temperature is first brought back to 25° C., or Curve C being above Curve A while Curve B is below Curve A), but also that a frequency change of about 95 MHz is observed at 15 GHz between Curves B and D. Since the theoretical frequency change due to thermal expansion over a 150° C. change in temperature (between Curves B and D) is about 14 MHz at 15 GHz, this means that there is a definite change in reluctance of the magnetic circuit.

By contrast, FIG. 3 shows that the frequency change is less than the theoretical frequency change due to thermal expansion. This means that silicone rubber pieces 50, having much greater thermal expansion than the nickel-iron magnetic material so that clamping pressure increases as pole tips 14 tend to move farther apart, provide compensation for temperature expansion. FIG. 3 also shows that stress hysteresis is virtually completely eliminated.

Figure 4:
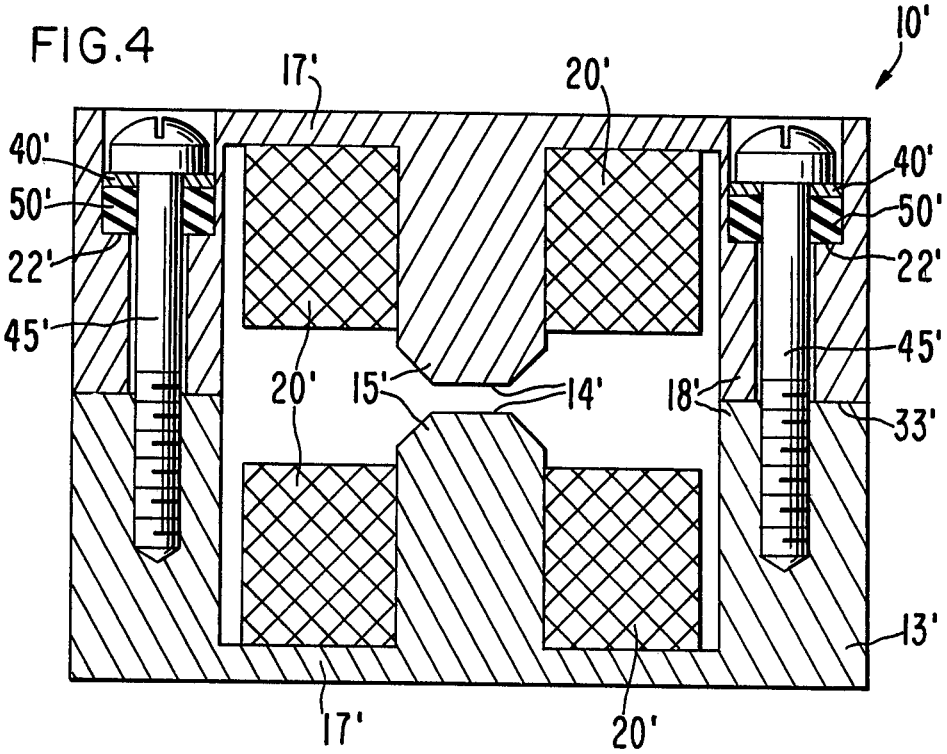
FIG. 4 is a sectional view of another assembly for providing a magnetic circuit, which also embodies the present invention.

FIG. 4 shows another means for providing a magnetic circuit which has a different design, but is also to be considered as embodying the present invention. Components corresponding to those of FIG. 1 are given like reference numerals, except two pieces of magnetic material 12' and 13' are directly in contact with and pressed against each other across plane 33', and they are maintained at a set relative position not by any intermediate body (like the support piece 30 of FIG. 1) but by screws 45' which are passed through between these pieces 12' and 13' across contact plane 33'. For this purpose, pieces 12' and 13' are provided with holes in their tubular wall sections 18' for screws 45' to pass through. Each hole has a ledge 22' which supports a ring-shaped silicone rubber piece 50'. A regular washer 40' is placed thereon for screw 45' to pass through both washer 40' and silicone rubber piece 50' so that the ledges 22' and washers 40' are essentially a functional equivalent of the flat surfaces 22 and 41 of FIG. 1, respectively, in that the compressive force keeping pieces 12' and 13' together is applied through the elastic medium of silicone rubber pieces across these surfaces.

The present invention has been described above in terms of only a few embodiments. The above description, however, is to be considered as illustrative rather than limiting, and this invention is accordingly to be broadly construed. For example, a structure or an assembly of structures which establishes the magnetic circuit of interest can be almost of any convenient shape and/or magnetic material. A supporting structure, annular or otherwise, may be absent as long as a means is provided for two clamped pieces of magnetic material which are maintained at a set relative position. The end pieces, whether used as covers or as washers, can be of any convenient shape and/or material as long as it can keep a silicone rubber piece pressed against one of the clamped pieces of magnetic material. The silicone rubber pieces, too, can be of any shape. Presence, or absence, of a layer or layers of whatever material between silicone rubber piece 50 and the flat surfaces 22 and 41 is also inmaterial as long as an overall tendency to compensate for thermal expansion and/or to eliminate stress hysteresis as described above is present. The scope of the invention is defined only by the following claims.

What is claimed is:

1. A combination comprising a first body of magnetic material having a first surface, said first body forming a boundary of a gap for establishing a useful magnetic field therein, a second body having a second surface, and a silicone rubber piece compressibly disposed between said first surface and said second surface in order to reduce the change in said useful magnetic field due to a temperature change by relieving stress in said first body in the direction of said useful magnetic field.

2. The combination of claim 1 wherein said first surface and said second surface are flat and said silicone rubber piece is planar, having uniform thickness.

3. The combination of claim 2 wherein said silicone rubber piece substantially entirely covers said first surface.

4. The combination of claim 2 wherein said first and second surfaces are perpendicular to said useful magnetic field.

5. The combination of claim 1 further comprising a means for establishing a magnetic field inside said first body.

6. The combination of claim 4 wherein said means includes a coil wound around a portion of said first body.

7. The combination of claim 1 which is a part of a YIG-tuned filter.

8. The combination of claim 1 further comprising a third body of magnetic material, said first body and said third body being directly in contact with each other.

9. The combination of claim 8 wherein said second body is adjustably attached to said third body.

10. A magnetic circuit comprising a first body of magnetic material, a second body of magnetic material, said first and second bodies defining a gap therebetween for establishing a useful magnetic field in said gap, a silicone rubber piece and a means for pressing said silicone rubber piece against said first body, the pressure applied by said means on said silicone rubber piece having the effect of compressing said first and second bodies directly against each other, and reducing the effect of temperature on said useful magnetic field.

11. A magnetic circuit comprising two identically structured magnet assemblies and a supporting structure in contact with said assemblies, said two assemblies being positioned symmetrically with respect to and facing opposite to each other, leaving a gap therebetween for establishing a useful magnetic field in said gap, each magnet assembly comprising a main unit of magnetic material, a silicone rubber piece and a cover, said cover and said main unit sandwiching said silicone rubber piece therebetween and said cover being adapted to attach to said supporting structure and to compress said main body against said supporting structure in such a way that the change in the dimension of said gap due to a change in the ambient temperature is reduced.

* * * * *